United States Patent [19]

Johnson, Sr.

[11] Patent Number: 4,968,410

[45] Date of Patent: Nov. 6, 1990

[54] OIL RECOVERY SYSTEM

[75] Inventor: Lester L. Johnson, Sr., Jacksonville, Fla.

[73] Assignee: Electrolube Devices, Inc., Jacksonville, Fla.

[21] Appl. No.: 402,569

[22] Filed: Sep. 5, 1989

[51] Int. Cl.[5] ..... C10G 33/00

[52] U.S. Cl. ..... 208/187; 208/184; 208/DIG. 1; 208/303; 208/360; 210/805

[58] Field of Search ..... 208/187, DIG. 1, 360, 208/303, 184; 210/805

[56] References Cited

U.S. PATENT DOCUMENTS

| | | | |
|---|---|---|---|
| 3,016,345 | 1/1962 | Price | 208/187 |
| 3,923,643 | 12/1975 | Lewis et al. | 208/187 |
| 3,923,644 | 12/1975 | Hindman | 208/187 |
| 4,444,654 | 4/1984 | Cargle et al. | 208/187 |
| 4,666,587 | 5/1987 | Martin | 208/187 |
| 4,784,751 | 11/1988 | McGehee | 208/187 |
| 4,789,461 | 12/1988 | Clare et al. | 208/187 |

*Primary Examiner*—Helane E. Myers
*Attorney, Agent, or Firm*—Arthur G. Yeager

[57] ABSTRACT

System for recovering purified oil from a mixture of oil, water, and solid particles; comprising allowing the mixture to settle while heating to about 160° F. to form a lower water layer and an upper oil layer; pumping off the water layer and passing it through a strainer to separate solids; pumping off the oil, passing it through a strainer to remove solids, heating the strained oil and passing it through a purification step including filtering fine solids, heating the oil to vaporize any volatile components, and separating the vapors so produced.

5 Claims, 1 Drawing Sheet

OIL RECOVERY SYSTEM

BACKGROUND OF THE INVENTION

Petroleum oil is used in many applications as a lubricant, cooling medium, electric insulator, and the like. Some applications for lubricating oil are found in environments where the oil becomes mixed with substantial amounts of water, sludge, metal cuttings, and other pollutants and other diluents. If the application involves any substantial volume of oil, it is usually cost-efficient to install a system for recovering from such a mixture the oil in purified form such that it may be recycled to the sites which require lubricating oil to function properly. For example, rolls, presses, dies, etc. in a steel mill require ample lubrication of bearings, journals, bushings, etc. and in use the oil becomes contaminated with water, dirt, metal cuttings, and the like. There is a need for a reliable system to purify the polluted oil for reuse.

It is an object of this invention to supply a novel system for recovering purified oil from a dirty mixture of oil, water, etc. It is another object of this invention to provide such a system to be used with an oil mixture containing high percentages of water. Still other objects may become apparent from the more detailed description which follows.

BRIEF SUMMARY OF THE INVENTION

This invention relates to a system for continuously recovering purified oil from a mixture of oil, water, and solid particles which comprises:

(a) allowing a mixture of oil, water and solid particles to settle in an unagitated vessel while maintaining the mixture at a temperature of about 160° F.; to form an upper oil layer and a lower water layer in the vessel;

(b) separating the water layer therefrom, passing it through a strainer to remove solid particles and conducting the strained water layer away for discharge as waste or recycling to other uses;

(c) conducting oil from the oil layer through a strainer to remove solid particles therefrom;

(d) pumping the oil leaving the strainer through a heater to maintain the oil temperature at about 160° F.; and (e) conducting the oil from the heater through a polishing step which involves filtering to remove fine solid particles, raising the temperature of the oil while in the physical form of a flowing liquid film to about 150–200° F. to remove vaporizable components therefrom, and removing the vapors from the vicinity of the flowing liquid film.

In specific, preferred embodiments of the invention the water may represent 5–20% by volume of the original mixture, and the solid particles may include metal cuttings.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
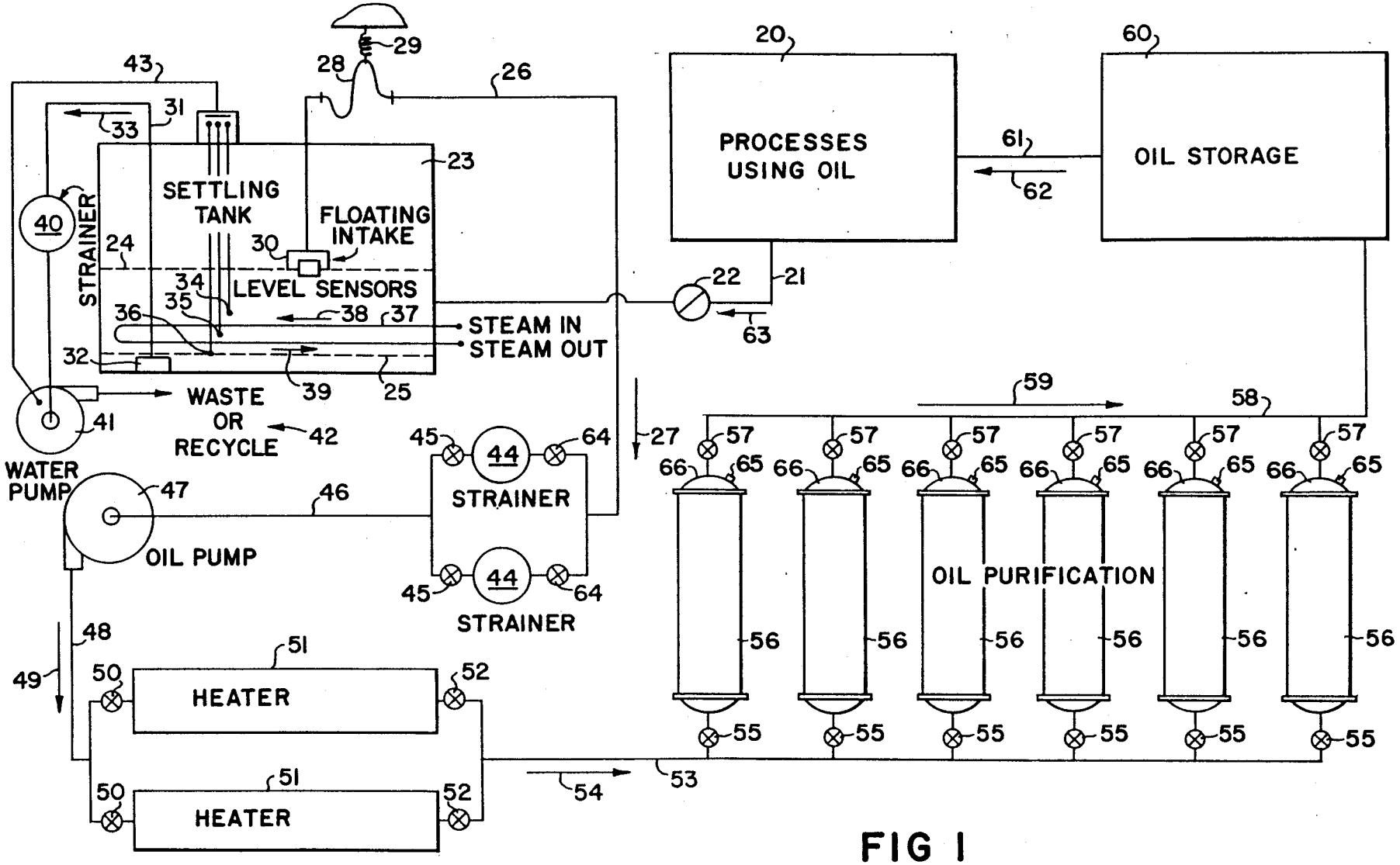
FIG. 1 is a schematic flow sheet of the present invention.

The various component parts and the novel features of this invention are best understood with reference to the accompanying drawings.

The system begins at 20 where any of a wide variety of processes is using oil and causing the oil to become diluted and/or contaminated (5–20% by volume) amounts of water and varying amounts of solid pollutants, e.g., dust, dirt, metal cuttings, and other solid materials used in processing plants. The polluted oil is collected and conducted via line 21 in the direction indicated by arrow 63 through check valve 22 to settling tank 23 where the mixture is allowed to stand quiescently and form two layers; namely, an oil layer 24 lying above a water layer 25. It is well known that the two phases separate readily and form a sharp line of demarcation. The water layer having an upper level 25 can be removed easily and substantially completely by drawing off water at any place below water level 25. In this instance an intake head 32 rests on the bottom of vessel 23 and the water is drawn off through line 31 through strainer 40 by the propulsion of water pump 41, the water moving through line 31 in the direction of arrow 33. Similarly, and perhaps simultaneously, oil is drawn off through line 20 through one or both of strainers 44 by the propulsion of oil pump 47.

In order to help the water and the oil entering settling tank 23 to separate quickly, a heating coil 37 is placed in settling tank 23. The mixture should be heated to about 160° F. to help the water and oil separate efficiently, and this is readily accomplished by circulating steam through coil 37, the steam entering in the direction of arrow 38 and exiting in the direction of arrow 39.

The oil line 26 extends into tank 23 to the upper level 24 of the oil layer and is kept there automatically by a floating intake head 30 which is designed to float on the oil. Since the oil level 24 will change from time to time, the line 26 includes a flexible portion 28 supported by a spring or a bungee cord that automatically extends or contracts to accommodate the intake line above floating head 30.

The water in the water layer below level 25 is generally treated as a waste stream, or alternatively, it may be treated for recycling. In this invention water pump and thus water level 25, is automatically controlled by level sensors 34, 35 and 36 to keep level 25 within certain depth limitations. When level 25 is at lower sensor 36, pump 41 is turned off, thereby, leaving a thin layer (e.g., 4 inches) of water as a lower layer in tank 23. When the water level 25 reaches middle sensor 35 (e.g., 8 inches from the bottom of tank 23), pump 41 is automatically turned on. If for any reason the water level 25 should reach a level as high as upper sensor 34 (e.g., 12 inches above the bottom of tank 23) pump 41 is turned on, an alarm is sounded, and oil purification units 56 are closed. This sensor 34 and its actions prevent water from entering the oil purification system and sounds an alarm for an operator's attention. These sensors 34, 35 and 36 are normally supplemented by several sight gauges in the wall of tank 23 to permit the operators to note levels 24 and 25 at any time. Sensors 34, 35 and 36 are generally electronically connected, as per line 43, to pump 41.

Strainer 40 is intended to be a separator to catch solid particles of large sizes that might be a danger to pump 41, such sizes generally being larger than about 0.10 inch.

Oil in line 26 is conducted in the direction of arrow 27 to either or both of strainers 44, which is similar to strainer 40 in removing large particles, e.g., larger than 0.10 inch. Two strainers 44 are shown, generally for the purpose of using one while the other is by-passed while being cleaned or otherwise maintained. Inlet valves 64 and outlet valves 45 permit either of strainers 44 to be removed from the oil processing stream. Oil from strainers 44 passes through line 46 to oil pump 47 which pumps oil through line 48 in the direction of arrow 49 to either or both of heaters 51. The oil is heated to about 160° F. in heaters 51, which preferably are electric resistance heaters, but which can be heated by steam coils or other heating medium. Two heaters 51 are shown, each to be of sufficient size and capacity to operate alone while the other is by-passed for cleaning or other maintenance purposes. Inlet valves 50 and outlet valves 52 permit either heater 51 to be removed from the main processing stream.

Hot oil leaving heaters 51 travels through line 53 in the direction of arrow 54 to an oil purification step accomplished by one or more oil purifiers 56 having inlet valves 55 and outlet valves 57 to permit any one or more of the purifiers to be on stream while others are off stream for cleaning and/or maintenance. Each purifier 56 is substantially the same as the oil reconditioning device described and claimed in my U.S. Pat. No. 4,758,338 containing in order from bottom to top (a) a first fabric bag full of filter material, (b) a second fabric bag full of filter material, (c) a felt pad, (d) a dispersion plate to cause the oil to pass through several tiers of tortuous passageways as a thin film, and (e) an electrically heated lid 66 having a vent 65 to release vapors but not to allow oil to pass through. Lid 66 is heated to a temperature of about 150°–200° F. causing vaporizable components, such as water, to be vaporized and to be expelled through vents 65. This purifier removes water and vaporizable components down to about 0.05% maximum, removes all solids down to 5 microns, and traps and neutralizes acids. The resulting hot oil is considered to be "polished", i.e., as good as new, and is passed through line 58 in the direction of arrow 59 to storage tank 60 to await future use in processes 20 or elsewhere.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A process for continuously recovering purified oil from a mixture of oil, water, and solid particles which comprises the steps of:

(a) settling a mixture of oil, water, and solid particles in an unagitated vessel while maintaining the mixture at a temperature of about 160° F. to form an upper oil layer with entrained solid particles and a lower water layer with entrained solid particles in the vessel;

(b) separating the water layer with entrained solid particles from the vessel and passing same through a strainer to remove solid particles therefrom and conducting the strained water layer away for discharge as waste or recycling to other uses;

(c) conducting oil and entrained solid particles from the oil layer through a strainer to remove large solid particles therefrom;

(d) pumping the oil from the strainer through a heater to maintain the oil temperature at about 160° F.;

(e) polishing the oil from the heater by filtering to remove fine solid particles, raising the temperature of the oil while in the physical form of a flowing liquid film to about 150°–200° F. to remove vaporizable components therefrom, and removing the vapors from the vicinity of the flowing liquid film; and (f) recovering the purified oil for reuse.

2. The process of claim 1 wherein step (b) includes the step of (g) pumping the water from the unagitated vessel via an outlet at the bottom of the vessel.

3. The process of claim 2 wherein said pumping step (g) is operated automatically by a plurality of switches operatively connected to an electrical pump and to a plurality of water level sensors.

4. The process of claim 1 wherein step (c) includes the step of (g) pumping the oil form the oil layer via an intake line with the entrance floating in the oil layer.

5. The process of claim 1 wherein the solid particles include metal particles in which large metal particles are removed in step (c) and fine metal particles are removed in step (e).

* * * * *